US009383759B2

(12) United States Patent
Abhishek et al.

(10) Patent No.: US 9,383,759 B2
(45) Date of Patent: Jul. 5, 2016

(54) VOLTAGE MONITORING SYSTEM

(71) Applicants: Kumar Abhishek, Ghaziabad (IN); Aniruddha Gupta, Ghaziabad (IN); Sunny Gupta, Noida (IN); Nitin Pant, New Delhi (IN)

(72) Inventors: Kumar Abhishek, Ghaziabad (IN); Aniruddha Gupta, Ghaziabad (IN); Sunny Gupta, Noida (IN); Nitin Pant, New Delhi (IN)

(73) Assignee: FREESCALE SEMICONDUCTOR, INC., Austin, TX (US)

( * ) Notice: Subject to any disclaimer, the term of this patent is extended or adjusted under 35 U.S.C. 154(b) by 151 days.

(21) Appl. No.: 14/509,039

(22) Filed: Oct. 7, 2014

(65) Prior Publication Data

US 2016/0098047 A1 Apr. 7, 2016

(51) Int. Cl.
*G05F 1/46* (2006.01)

(52) U.S. Cl.
CPC ..... *G05F 1/462* (2013.01)

(58) Field of Classification Search
CPC ..... G05F 1/00; G05F 1/462; H03F 1/00; H03F 1/303; H03F 3/00; H03F 3/45183; H03F 3/45475; H03F 3/45973; H03K 5/00; H03K 5/003; H03M 1/00; H03M 1/66
USPC ..... 327/307
See application file for complete search history.

(56) References Cited

U.S. PATENT DOCUMENTS 4,546,326 A 10/1985 Van Uffelen et al.
5,300,824 A 4/1994 Iyengar
6,762,629 B2 7/2004 Tam et al.
7,085,943 B2 8/2006 Chun et al.
7,236,894 B2 * 6/2007 Oh ..... G11C 5/147 365/189.09
7,642,764 B2 1/2010 Burton et al.
7,811,917 B2 10/2010 Marshall
7,890,781 B2 2/2011 Gunther et al.
8,689,023 B2 4/2014 Gupta et al.
2005/0210346 A1 * 9/2005 Comaschi ..... G06F 1/3203 714/724
2005/0218871 A1 10/2005 Kang
2007/0216376 A1 9/2007 Ogawa
2010/0165585 A1 7/2010 Lin et al.
2012/0218034 A1 * 8/2012 Turullols ..... G06F 1/28 327/540
2013/0086396 A1 4/2013 Liu

* cited by examiner

*Primary Examiner* — John Poos
*Assistant Examiner* — David Mattison
(74) *Attorney, Agent, or Firm* — Charles E. Bergere

(57) ABSTRACT

An integrated circuit (IC) includes a digital-to-analog converter (DAC), a voltage monitoring circuit, and a controller. The voltage monitoring circuit includes low voltage detect (LVD) and low voltage warning (LVW) circuits that generate LVD and LVW reference voltage signals. The controller generates and stores a voltage margin word (a difference between first and second DAC words that correspond to the LVD and LVW reference voltage signals, respectively). The controller compares the voltage margin word with predetermined maximum and minimum voltage margin words. If the voltage margin word does not lie between the predetermined maximum and minimum voltage margin words, the controller generates a voltage trimming signal that scales the LVW reference voltage signal. After scaling, if the voltage margin word lies between the predetermined maximum and minimum voltage margin words, the controller generates a calibration pass signal, otherwise the controller generates a calibration fail signal.

18 Claims, 3 Drawing Sheets

VOLTAGE MONITORING SYSTEM

BACKGROUND OF THE INVENTION

The present invention relates generally to integrated circuits, and, more particularly, to a voltage monitoring system for an integrated circuit.

Integrated circuits (IC) include miniature electronic components such as inductors, resistors, capacitors, and transistors, often on a single chip. Over the years, these circuit components have shrunk in size and the number of components integrated on a single chip has increased dramatically. With the reduction in size and the increased number of components, increased power consumption has become a major issue. The total power consumption of an IC is a sum of its static and dynamic power consumption. Static power consumption increases with an increase in leakage power when the IC is powered down while dynamic power consumption increases with an increase in operating voltages and frequencies of the IC when the IC is powered up.

Various solutions are available to reduce the power consumption of the IC. One such solution is dynamic voltage scaling (DVS), a power management technique implemented by integrating a power management controller (PMC) and a voltage regulator in the IC. In DVS, the PMC monitors operating voltages and determines power requirements of the components of the IC. The voltage regulator dynamically changes the operating voltages of the components based on the power requirements of the IC. If the PMC determines that the power requirement of the components is high, then the PMC instructs the voltage regulator to scale up the operating voltages. On the other hand, if the PMC determines that the power requirement of the components is low, the PMC instructs the voltage regulator to scale down the operating voltages. Thus, DVS reduces the power consumption of the IC by scaling down the operating voltages when the power requirement of the components is low.

The PMC includes a voltage monitoring circuit and a reference voltage generation circuit. The voltage monitoring circuit includes low voltage detectors (LVD) and low voltage warning (LVW) circuits. The reference voltage generation circuit generates LVD and LVW reference voltage signals. The LVD reference voltage signal has a voltage level that represents a lowest operating voltage of the IC, and if the operating voltage drops below the voltage level of the LVD reference voltage signal, the IC is reset. The LVW reference voltage signal has a voltage level that represents a threshold operating voltage of the IC and is greater than the voltage level of the LVD reference voltage signal. The LVD monitoring circuit monitors and compares the IC operating voltage with the LVD reference voltage signal. When the operating voltage equals the LVD reference voltage signal, the LVD monitoring circuit generates a LVD detect signal and the IC is reset. The LVW monitoring circuit also monitors and compares the IC operating voltage with the LVW reference voltage signal. When the operating voltage equals the LVW reference voltage signal, the LVW monitoring circuit generates a LVW detect signal. The LVW detect signal indicates that a further drop in the operating voltage will result in the operating voltage being equal to the LVD reference voltage signal and hence the IC is reset.

The voltage regulator scales the IC operating voltage based on the LVW detect signal in U.S. Pat. No. 8,689,023. A difference between the voltage levels of the LVD and LVW reference voltage signals is critical to the successful execution of the DVS technique. Factors such as IC circuit design, ageing, and manufacturing processes result in a variation of the voltage level difference between the LVD and LVW reference voltage signals. When the difference between the voltage levels of the LVW and LVD reference voltage signals is low and the voltage regulator scales down the operating voltage to the voltage level of the LVW reference voltage signal by the DVS technique, a sudden change in the power requirement of the IC may result in the operating voltage dropping further and becoming equal to the voltage level of the LVD reference voltage signal, thereby resetting the IC. As resetting reduces the available functional time of the IC, such a power saving technique is undesirable. When the voltage level of the LVW reference voltage signal is significantly greater than the voltage level of the LVD reference voltage signal, the voltage regulator using the DVS technique has a limited range of voltage levels (between the voltage level of the LVW reference voltage signal and a highest operating voltage level) to scale the operating voltage of the IC. Hence, the use of the DVS technique to save power is limited. Thus, there is a need to maintain an optimized voltage level difference between the LVD and LVW reference voltage signals to prevent the IC from transitioning to the reset state.

One solution to maintain an optimized voltage level difference between the LVD and LVW reference voltage signals is to avoid mismatch errors such as systematic, random, and gradient mismatches in layout designs of the LVD and LVW monitoring circuits. However, the matched LVD and LVW monitoring circuits do not maintain a constant voltage level difference between the LVD and LVW reference voltage signals at different operating temperatures of the IC. Thus, an improvement in the circuit design and manufacturing process does not guarantee an optimized voltage level difference between the LVD and LVW reference voltage signals under different operating conditions. Alternatively, precision voltage reference circuits may be used by the LVD and LVW monitoring circuits. However, the use of precision voltage reference circuits increases the cost of the IC.

Therefore, it would be advantageous to have a voltage monitoring system that maintains an optimized difference between the voltage levels of the LVD and LVW reference voltage signals.

BRIEF DESCRIPTION OF THE DRAWINGS

The following detailed description of the preferred embodiments of the present invention will be better understood when read in conjunction with the appended drawings. The present invention is illustrated by way of example, and not limited by the accompanying figures, in which like references indicate similar elements.

DETAILED DESCRIPTION

Figure 1:
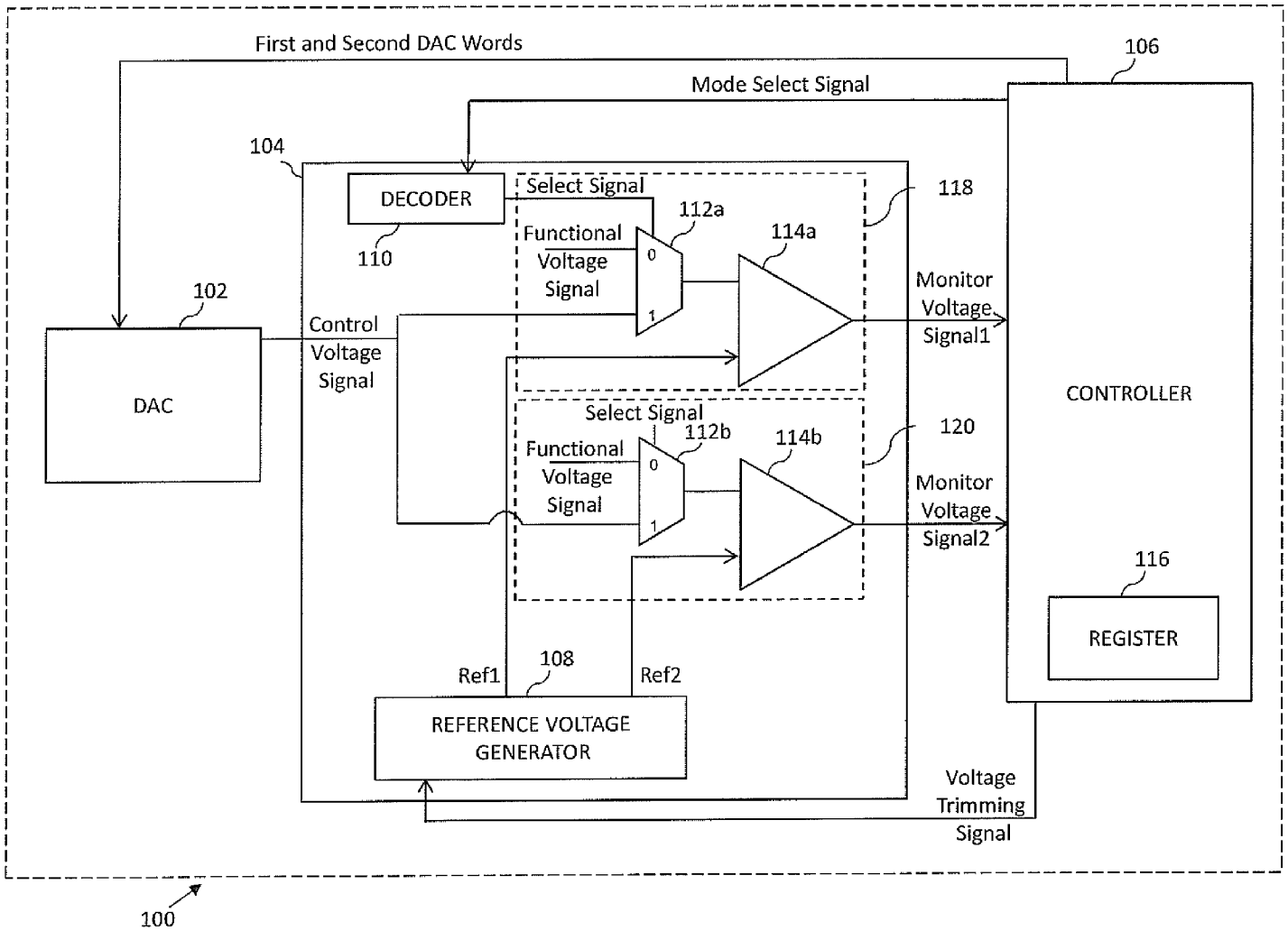
FIG. 1 is a schematic block diagram of an integrated circuit (IC) with a voltage monitoring system in accordance with an embodiment of the present invention.

The detailed description of the appended drawings is intended as a description of the currently preferred embodiments of the present invention, and is not intended to represent the only form in which the present invention may be practiced. It is to be understood that the same or equivalent functions may be accomplished by different embodiments that are intended to be encompassed within the spirit and scope of the present invention. As used herein, the term multiplexer has been abbreviated as a mux.

In an embodiment of the present invention a system for calibrating a reference voltage signal in an integrated circuit (IC) is provided. The IC includes a digital-to-analog converter (DAC), a voltage monitoring circuit, and a digital controller. The voltage monitoring circuit includes a reference voltage generator, and first and second comparators. The DAC receives first and second sets of digital control words and generates corresponding first and second sets of control voltage signals during first and second calibration cycles, respectively. The reference voltage generator generates first and second reference voltage signals. The first comparator receives the first set of control voltage signals from the DAC, and the first reference voltage signal from the reference voltage generator, and outputs a first monitor voltage signal during the first calibration cycle. The first monitor voltage signal is high when a first control voltage signal of the first set of the control voltage signals is less than the first reference voltage signal. The first monitor voltage signal is low when the first control voltage signal is greater than the first reference voltage signal.

The second comparator receiver the second set of control voltage signals from the DAC, and the second reference voltage signal from the reference voltage generator, and outputs a second monitor voltage signal during the second calibration cycle. The second monitor voltage signal is high when a first control voltage signal of the second set of the control voltage signals is less than the second reference voltage signal. The second monitor voltage signal is low when the first control voltage signal of the second set of control voltage signals is greater than the second reference voltage signal. The digital controller is connected to the voltage monitoring circuit and the DAC, and receives the first and second monitor voltage signals and generates the first and second sets of digital control words in the first and second calibration cycles, respectively, such that a first reference voltage digital control word of the first set of digital control words corresponds to the first reference voltage signal at the end of the first calibration cycle and a second reference voltage digital control word corresponds to the second reference voltage signal at the end of the second calibration cycle. The digital controller also generates a voltage margin word that corresponds to a difference between the first and second reference voltage digital control words at the end of the first and second calibration cycles, generates a voltage trimming signal based on a comparison of the voltage margin word and at least one of predetermined maximum and minimum reference voltage words, and calibrates the second reference voltage signal based on the voltage trimming signal.

The voltage monitoring circuit further includes first and second multiplexers or muxes. The first mux receives the first set of control voltage signals from the DAC, and a functional voltage signal when the IC is in a functional mode. The also mux has a select terminal for receiving a select signal, and an output terminal for outputting the first set of control voltage signals in the first calibration cycle. The second mux receives the second set of control voltage signals from the DAC and the functional voltage signal of the IC when the IC is in the functional mode. The second mux also has a select terminal for receiving the select signal and an output terminal for outputting the second set of control voltage signals in the second calibration cycle.

In another embodiment of the present invention, a method of calibrating a reference voltage signal of an IC is provided. The IC includes a DAC, a voltage monitoring circuit, and a digital controller. The voltage monitoring circuit includes a reference voltage generator, and first and second comparators. The method includes generating first and second monitor voltage signals based on first and second sets of control voltage signals and first and second reference voltage signals by the first and second comparators, respectively, during first and second calibration cycles, respectively. The digital controller generates first and second sets of digital control words corresponding to the first and second sets of control voltage signals during the first and second calibration cycles, respectively, such that a first reference voltage digital control word of the first set of digital control words corresponds to the first reference voltage signal at the end of the first calibration cycle and a second reference voltage digital control word corresponds to the second reference voltage signal at the end of the second calibration cycle. The digital controller generates a voltage margin word that corresponds to a difference between the first and second reference voltage digital control words at the end of the first and second calibration cycles. The digital controller generates a voltage trimming signal based on a comparison between the voltage margin word with at least one of predetermined maximum and minimum reference voltage words. The digital controller calibrates the second reference voltage signal based on the voltage trimming signal.

Various embodiments of the present invention provide an IC that includes a DAC, a voltage monitoring circuit, and a digital controller. The voltage monitoring circuit includes a reference voltage generator, and first and second comparators. The DAC generates first and second sets of control voltage signals corresponding to first and second sets of digital control words during first and second calibration cycles, respectively. The reference voltage generator generates first and second reference voltage signals. The first comparator receives the first set of control voltage signals and the first reference voltage signal by way of the first multiplexer, and outputs a first monitor voltage signal during the first calibration cycle. The second comparator receives the second set of control voltage signals and the second reference voltage signal by way of the second multiplexer, and outputs a second monitor voltage signal during the second calibration cycle. The digital controller generates first and second reference voltage digital control words that correspond to the first and second reference voltage signals at the end of the first and second calibration cycles, respectively. The digital controller further generates a voltage margin word that corresponds to a difference between the first and second reference voltage digital control words, and a voltage trimming signal based on a comparison between the voltage margin word and at least one of predetermined maximum and minimum reference voltage words. The digital controller calibrates the second reference voltage signal based on the voltage trimming signal. Thus, the digital controller maintains an optimized difference between the voltage levels of the first and second reference voltage signals by at least one of scaling up and scaling down a voltage level of the second reference voltage signal. Dynamic voltage scaling (DVS) is a power management technique that scales an operating voltage of the IC based on a power requirement thereof in the functional mode. Since the digital controller maintains the optimized difference between the voltage levels of the first and second reference voltage signals, the DVS technique that is implemented in the functional mode does not result in a reset condition. The digital controller facilitates in-field and real-time calibration of the first and second reference voltage signals without incurring additional costs and eliminates the need of matching of the LVD and LVW monitoring circuits layout designs.

Referring now to FIG. 1, an integrated circuit (IC) 100 in accordance with an embodiment of the present invention is shown. The IC 100 operates in functional and calibration modes and includes an N-bit digital-to-analog converter (DAC) 102, a voltage monitoring circuit 104, and a digital controller 106. The voltage monitoring circuit 104 includes a reference voltage generator 108, a decoder 110, first and second multiplexers or muxes 112*a* and 112*b*, and first and second comparators 114*a* and 114*b*. The digital controller 106 includes a register 116. The first mux 112*a* and the first comparator 114*a* form a low voltage detect (LVD) circuit 118 while the second mux 112*b* and the second comparator 114*b* form a low voltage warning (LVW) circuit 120. The LVD and LVW circuits 118 and 120 generate LVD and LVW detect signals. In an embodiment of the present invention, the voltage monitoring circuit 104 is a power management controller (PMC).

The DAC 102 receives N-bit digital control words (hereinafter referred to as N-bit words) and high and low reference voltage signals ($V_{hi}$ and $V_{lo}$) from a reference voltage generating circuit (not shown) and generates corresponding control voltage signals. The decoder 110 receives a mode select signal and decodes the mode of operation of the IC 100. The first mux 112*a* has a first input terminal for receiving functional voltage signals of the IC 100, a second input terminal connected to the DAC 102 for receiving the control voltage signals, a select input terminal connected to the decoder 110 for receiving a select signal, and an output terminal for outputting the functional voltage signals of the IC when the IC 100 is in the functional mode and the control voltage signals when the IC 100 is in the calibration mode. The second mux 112*b* has a first input terminal for receiving the functional voltage signals of the IC 100, a second input terminal connected to the DAC 102 for receiving the control voltage signals, a select input terminal connected to the decoder 110 for receiving the select signal, and an output terminal for outputting the functional voltage signals of the IC 100 when the IC 100 is in the functional mode and the control voltage signals when the IC 100 is in the calibration mode. The reference voltage generator 108 generates first and second reference voltage signals (hereinafter referred to as low voltage detect (LVD) and low voltage warning (LVW) reference voltage signals, respectively). The first comparator 114*a* has a first input terminal connected to the output terminal of the first mux 112*a* for receiving the control voltage signals when the IC 100 is in the calibration mode and the functional voltage signals when the IC 100 is in the functional mode, a second input terminal connected to the reference voltage generator 108 for receiving the LVD reference voltage signal, and an output terminal for outputting a first monitor voltage signal. The first comparator 114*a* outputs the first monitor voltage signal at logic high state when a voltage level of a control voltage signal is less than or equal to that of the LVD reference voltage signal and at logic low state when a voltage level of the control voltage signal is greater than that of the LVD reference voltage signal. The second comparator 114*b* has a first input terminal connected to the output terminal of the second mux 112*b* for receiving the control voltage signals in the calibration mode and the functional voltage signals in the functional mode, a second input terminal connected to the reference voltage generator 108 for receiving the LVW reference voltage signal, and an output terminal for outputting a second monitor voltage signal. The second comparator 114*b* outputs the second monitor voltage signal at logic high state when a voltage level of the control voltage signal is less than or equal to that of the LVW reference voltage signal and at logic low state when a voltage level of the control voltage signals is greater than that of the LVW reference voltage signal.

The register 116 stores predetermined maximum and minimum voltage margin N-bit words that correspond to desired maximum and minimum differences between the LVD and LVW reference voltage signals, respectively, a reference start high N-bit word, and a reference start low N-bit word. The digital controller 106 generates N-bit words based on the reference start high and low N-bit words. The digital controller 106 is connected to the output terminal of the first and second comparators 114*a* and 114*b* for receiving the first and second monitor voltage signals and generating first and second N-bit words. The digital controller 106 generates and provides the mode select signal to the decoder 110. The mode select signal is a digital word. The decoder 110 generates a select signal to indicate the mode of operation of the IC 100 based on the mode select signal and decodes the mode select signal to select at least one of the LVD and LVW circuits 118 and 120 during the calibration mode of operation. When the select signal is at logic low state the IC 100 operates in the functional mode. When the select signal is at logic high state the IC 100 operates in the calibration mode. The calibration mode includes first and second calibration cycles. In the first calibration cycle, the digital controller 106 selects the LVD circuit 118 to determine an LVD assert point. The LVD assert point is attained when the first monitor voltage signal toggles from logic low to logic high state. In the second calibration cycle, the digital controller 106 selects the LVW circuit 120 to determine an LVW assert point. The LVW assert point is attained when the second monitor voltage signal toggles from logic low to logic high state. The digital controller 106 generates a voltage margin N-bit word that corresponds to the difference between the LVD and LVW reference voltage signals and calibrates the LVW reference voltage signal to maintain the voltage margin N-bit word in a desired range of voltage margin N-bit words. Maintaining the voltage margin N-bit word in the desired range of voltage margin N-bit words is of critical importance for the execution of DVS.

When the IC 100 is in the calibration mode, the digital controller 106 receives a calibration enable signal from a processor (not shown) of the IC 100 and begins the first calibration cycle. The register 116 provides the reference start high and low N-bit words corresponding to the high and low reference voltage signals ($V_{hi}$ and $V_{lo}$) and the digital controller 106 generates a reference start N-bit word which is equal to the reference start high N-bit word. The DAC 102 receives the reference start N-bit word and generates a start control voltage signal corresponding to the reference start N-bit word. The first mux 112*a* receives the start control voltage signal at the second input terminal, the logic high select signal at the select input terminal, and outputs the start control voltage signal at the output terminal. The first comparator 114*a* receives the start control voltage signal at the first input terminal and generates the first monitor voltage signal based on a comparison of the start control voltage signal and the LVD reference voltage signal. The digital controller 106 receives the first monitor voltage signal and initiates a binary search algorithm to obtain an N-bit word that is substantially equal to the LVD reference voltage signal. The binary search algorithm is explained further in FIG. 2. The binary search algorithm runs a first predetermined number of iterations. The first predetermined number of iterations is determined experimentally and stored in the digital controller 106. In a previous iteration of the binary search algorithm, the digital controller 106 generates a reference final N-bit word. The DAC 102 receives the reference final N-bit word and generates a first control voltage signal corresponding to the reference final N-bit word. The first mux 112*a* receives the first control voltage signal at the second input terminal and the logic high select signal at the select input terminal, and outputs the first control voltage signal at the output terminal. The first comparator 114*a* receives the first control voltage signal and the LVD reference voltage signal and generates the first monitor voltage signal. The first monitor voltage signal indicates the digital controller 106 that the first control voltage signal corresponding to the reference final N-bit word is substantially equal to the LVD reference voltage signal. The reference final N-bit word is referred to as a first DAC word (also referred to as a first reference voltage digital control word). The digital controller 106 stores the first DAC word at the end of the first calibration cycle.

Upon obtaining the first DAC word, the second calibration cycle begins. In the second calibration cycle, the decoder 110 receives the mode select signal from the digital controller 106 and decodes the mode select signal to select the LVW circuit 120. The register 116 provides the reference start high and low N-bit words corresponding to the high and low reference voltage signals ($V_{hi}$ and $V_{lo}$) and the digital controller 106 generates the reference start N-bit word which is equal to the reference start high N-bit word. The DAC 102 receives the reference start N-bit word and generates the start control voltage signal corresponding to the reference start N-bit word. The second mux 112*b* receives the start control voltage signal at the second input terminal, the logic high select signal at the select input terminal, and outputs the start control voltage signal at the output terminal. The second comparator 114*b* receives the start control voltage signal and generates the second monitor voltage signal based on a comparison of the start control voltage signal and the LVW reference voltage signal. The digital controller 106 receives the second monitor voltage signal and initiates the binary search algorithm to obtain an N-bit word that is substantially equal to the LVW reference voltage signal. In the previous iteration of the binary search algorithm, the digital controller 106 generates a reference final N-bit word. The DAC 102 receives the reference final N-bit word and generates a second control voltage signal corresponding to the reference final N-bit word. The second mux 112*b* receives the second control voltage signal at the second input terminal, the logic high select signal at the select input terminal, and outputs the second control voltage signal at the output terminal. The second comparator 114*b* receives the second control voltage signal at the first input terminal and the LVW reference voltage signal and generates the second monitor voltage signal. The second monitor voltage signal indicates to the digital controller 106 that the second control voltage signal corresponding to the reference final N-bit word is substantially equal to the LVW reference voltage signal. The reference final N-bit word is referred to as a second DAC word (also referred to as a second reference voltage digital control word). The digital controller 106 stores the second DAC word at the end of the second calibration cycle.

Thereafter, the digital controller 106 calculates the voltage margin N-bit word that corresponds to a difference between the first and second DAC words. The digital controller 106 compares the voltage margin N-bit word with the predetermined maximum and minimum voltage margin N-bit words. If the voltage margin N-bit word is greater than the predetermined minimum voltage margin N-bit word and is less than the predetermined maximum voltage margin N-bit word, the digital controller 106 determines that the difference between the LVD and LVW reference voltage signals is in the desired range of voltage margin N-bit words and generates a calibration pass signal. However, if the voltage margin N-bit word is greater than the predetermined maximum voltage margin N-bit word, the digital controller 106 generates and provides a voltage trimming signal to the reference voltage generator 108. The reference voltage generator 108 reduces the voltage level of the LVW reference voltage signal based on the voltage trimming signal. Similarly, if the voltage margin N-bit word is less than the predetermined minimum voltage margin N-bit word, the digital controller 106 generates and provides the voltage trimming signal to the reference voltage generator 108. The reference voltage generator 108 increases the voltage level of the LVW reference voltage signal. Thus, the digital controller 106 trims the voltage level of the LVW reference voltage signal to obtain a trimmed LVW reference voltage signal. Once the voltage level of the LVW reference voltage signal is trimmed, the aforementioned second calibration cycle is repeated with the trimmed LVW reference voltage signal to generate a new second DAC word. The digital controller 106 calculates a voltage margin N-bit word that corresponds to a difference between the first and new second DAC words. The digital controller 106 compares the voltage margin N-bit word with the predetermined maximum and minimum voltage margin N-bit words. Thus, the calibration process is repeated for a predefined number of times as defined by the user. If the digital controller 106 successfully calibrates the LVW reference voltage signal i.e., the voltage margin N-bit word is in the desired range of voltage margin N-bit words, the digital controller 106 generates the calibration pass signal. If the digital controller 106 is unsuccessful in calibrating the LVW reference voltage signal i.e., the voltage margin N-bit word is greater than the predetermined maximum voltage margin N-bit word or less than the predetermined minimum voltage margin N-bit word, the digital controller 106 generates a calibration fail signal. The calibration fail signal indicates that it may be unsafe to implement any power saving technique such as the DVS technique for power management as it may result in a reset of the IC when the DVS technique is active to save power.

Figure 2:
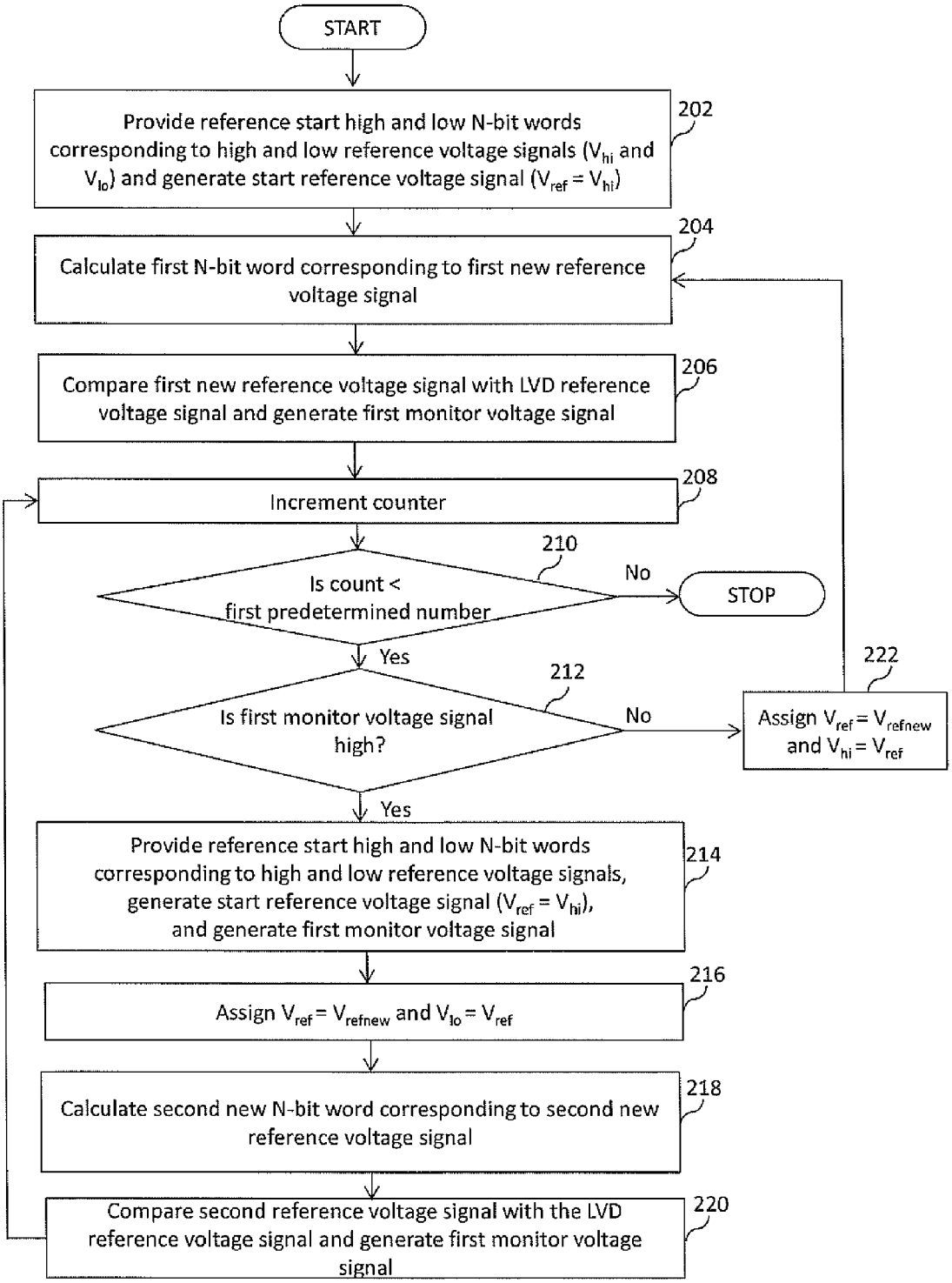
FIG. 2 is a flow chart illustrating a binary search algorithm to calculate LVD and LVW assert points of the voltage monitoring system of the IC of FIG. 1 in accordance with an embodiment of the present invention.

Referring to FIG. 2, a flow chart illustrating the binary search algorithm by the digital controller 106 to obtain the first DAC word, in accordance with an embodiment of the present invention is shown. At step 202, the register 116 provides the reference start high N-bit word and the reference start low N-bit word corresponding to the high and low reference voltage signals ($V_{hi}$ and $V_{lo}$) and the digital controller 106 generates a reference start N-bit word which is equal to the reference start high N-bit word. The DAC 102 receives the reference start N-bit word and generates a reference voltage signal ($V_{ref}$), which is equal to the high reference voltage signal ($V_{ref}=V_{hi}$), also referred to as the start control voltage signal. At step 204, the digital controller 106 calculates a first N-bit word, as given by equation (1) below:

$$(V_{refnew})=V_{ref}-(V_{hi}-V_{lo})/2 \quad (1)$$

The DAC 102 receives the first N-bit word and generates a corresponding first new reference voltage signal ($V_{refnew}$). At step 206, the first comparator 112*a* compares the first new reference voltage signal ($V_{refnew}$) with the LVD reference voltage signal and generates the first monitor voltage signal. At step 208, a counter increments a count by binary one. The count corresponds to the first predetermined number of iterations of the binary algorithm. In an embodiment of the present invention, the first predetermined number of iterations is equal to a sum of number of bits of the first DAC word i.e., N and a number of times the LVD circuit 118 toggles from logic low to high state. At step 210, a check is performed to determine whether the count is less than the first predetermined number. If, at step 210, it is determined that the count is less than the first predetermined number, step 212 is performed. At step 212, the digital controller 106 determines a logic state of the first monitor voltage signal. If, at step 212, it is determined that the first monitor voltage signal is at logic high state, step 214 is performed. The first monitor voltage signal at logic high state indicates that a voltage level of the first new reference voltage signal ($V_{refnew}$) is less than or equal to the voltage level of the LVD reference voltage signal and hence, the LVD circuit 118 toggles from logic low to high state. At step 214, the register 116 provides the reference start high N-bit word and the reference start low N-bit word corresponding to the high and low reference voltage signals ($V_{hi}$ and $V_{lo}$) to the DAC 102. The step 214 is performed because the first monitor voltage signal toggles from logic high to logic low state when the LVD circuit 118 compares the reference voltage signal ($V_{ref}=V_{hi}$) with the LVD reference voltage signal. It is well known to those of skill in the art that the LVD reference voltage signal toggles between a high LVD reference voltage signal and a low LVD reference voltage signal based on the logic state of the first monitor voltage signal. When the first monitor voltage signal is at logic high state, the LVD circuit 118 selects the high LVD reference voltage signal as the LVD reference voltage signal. When the first monitor voltage signal is at logic low state, the LVD circuit 118 selects the low LVD reference voltage signal as the LVD reference voltage signal. Such switching of the LVD reference voltage signal is known as hysteresis of the LVD circuit 118. Due to hysteresis, after the step 214, the LVD circuit 118 receives the high LVD reference voltage signal as the LVD reference voltage signal and consequently, the first DAC word generated at the end of the first calibration cycle has an error. Thus, the DAC 102 is provided with the reference voltage signal ($V_{ref}$), which is equal to the high reference voltage signal ($V_{ref}=V_{hi}$) so that the first monitor voltage signal toggles from logic high to logic low state and consequently the LVD circuit 118 receives only the low LVD reference voltage signal as the LVD reference voltage signal. At step 216, the DAC 102 uses the first new reference voltage signal as the reference voltage signal ($V_{ref}=V_{refnew}$) and the reference voltage signal as the low reference voltage signal ($V_{lo}=V_{ref}$) for further calculations. At step 218, the digital controller 106 calculates a second new N-bit word by using the following formula:

$$(V_{refnew})=V_{ref}(V_{hi}-V_{lo})/2 \quad (2)$$

The DAC 102 receives the second new N-bit word and generates a corresponding second new reference voltage signal ($V_{refnew}$). At step 220, the first comparator 112*a* compares the second new reference voltage signal ($V_{refnew}$) with the LVD reference voltage signal and generates the first monitor voltage signal. After the second new reference voltage signal ($V_{refnew}$) is obtained, step 208 is repeated. If it is determined, at step 212, that the first monitor voltage signal is at logic low state, step 222 is performed. At step 222, the DAC 102 uses the first new reference voltage signal as the reference voltage signal ($V_{ref}=V_{refnew}$) and the reference voltage signal as the high reference voltage signal ($V_{hi}=V_{ref}$) for subsequent calculations. After step 222, step 204 is repeated. By the end of the last iteration a reference voltage signal ($V_{ref}$) corresponding to the first DAC word and substantially equal to the LVD reference voltage signal is obtained. It will be apparent to those skilled in the art, that the aforementioned binary search algorithm is implemented to obtain the second DAC as well.

Table A illustrates the iterations of the binary search algorithm to obtain the first DAC word.

TABLE A

| D ($V_{hi}$) | D ($V_{lo}$) | D ($V_{refnew}$) | $V_{hi}$ (V) | $V_{lo}$ (V) | $V_{refnew}$ (V) | First Monitor Voltage Signal |
|---|---|---|---|---|---|---|
| | | 1024 | | | 1.25 | 0 |
| 1024 | 0 | 512 | 1.25 | 0 | 0.625 | 1 |
| | | 1024 | | | 1.25 | 0 |
| 1024 | 512 | 768 | 1.25 | 0.625 | 0.9375 | 1 |
| | | 1024 | | | 1.25 | 0 |
| 1024 | 768 | 896 | 1.25 | 0.9375 | 1.09375 | 1 |
| | | 1024 | | | 1.25 | 0 |
| 1024 | 896 | 960 | 1.25 | 1.09375 | 1.171875 | 0 |
| 960 | 896 | 928 | 1.171875 | 1.093775 | 1.1328125 | 1 |
| | | 1024 | | | 1.25 | 0 |
| 960 | 928 | 944 | 1.171875 | 1.1328125 | 1.1523437 | 0 |
| 944 | 928 | 936 | 1.1523437 | 1.1328125 | 1.1425781 | 1 |
| | | 1024 | | | 1.25 | 0 |
| 944 | 936 | 940 | 1.1523437 | 1.1425781 | 1.1474609 | 1 |
| | | 1024 | | | 1.25 | 0 |
| 944 | 940 | 942 | 1.1523437 | 1.1474609 | 1.1499023 | 1 |
| | | 1024 | | | 1.25 | 0 |
| 944 | 942 | 943 | 1.1523437 | 1.1499023 | 1.1511230 | 0 |

In the above example, the high reference voltage signal ($V_{hi}$) is 1.25 volts (V), the low reference voltage signal ($V_{lo}$) is 0V, and the LVD reference voltage signal is 1.15V. The reference voltage signal that is substantially equal to the LVD reference voltage signal and the corresponding first DAC word obtained at the end of the binary search algorithm are 1.1511230V and 943, respectively. Thus, an accurate first DAC word is obtained as the register 116 provides the reference start N-bit word and the reference start low N-bit word corresponding to the high and low reference voltage signals ($V_{hi}$ and $V_{lo}$) to the digital controller 106 when the LVD circuit 118 toggles from logic low to logic high state.

Figure 3:
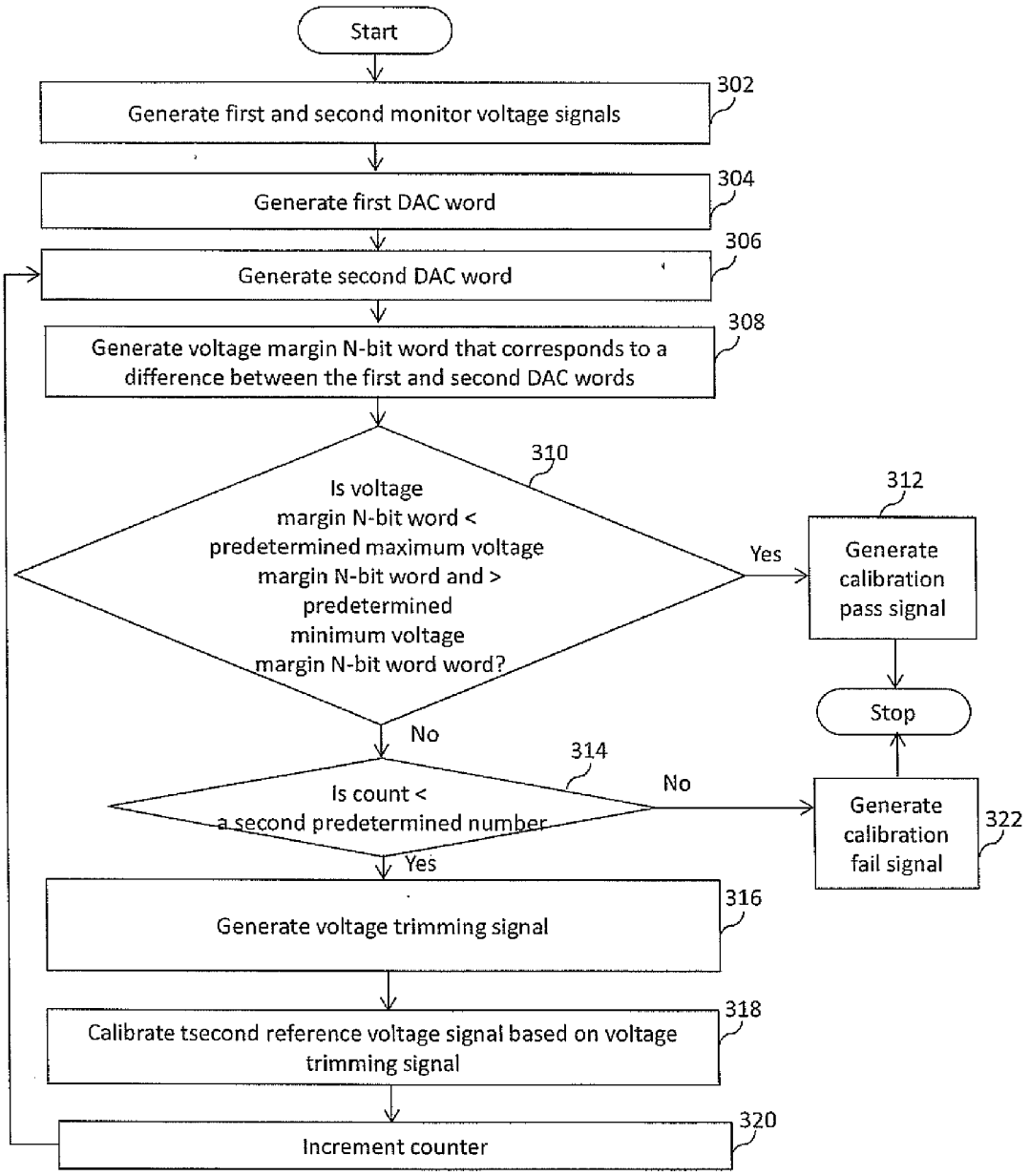
FIG. 3 is a flow chart illustrating a method of calibrating a reference voltage signal generated by the voltage monitoring system of the IC of FIG. 1 in accordance with an embodiment of the present invention.

Referring to FIG. 3, a flow chart illustrating the method of calibrating the LVW reference voltage signal in accordance with an embodiment of the present invention is shown. At step 302, the first and second comparators 114*a* and 114*b* generate the first and second monitor voltage signals at the end of first and second calibration cycles, respectively. At step 304, the digital controller 106 generates the first DAC word corresponding to the LVD reference voltage signal. At step 306, the digital controller 106 generates the second DAC word corresponding to the LVW reference voltage signal. At step 308, the digital controller 106 generates the voltage margin N-bit word that corresponds to the difference between the first and second DAC words and stores the same. At step 310, a check is performed to determine if the voltage margin N-bit word is less than the predetermined maximum voltage margin N-bit word and greater than the predetermined minimum voltage margin N-bit word. If at step 310 it is determined that the voltage margin N-bit word is less than the predetermined maximum voltage margin N-bit word and greater than the predetermined minimum voltage margin N-bit word, then step 312 is performed. At step 312, the digital controller 106 generates the calibration pass signal. If at step 310 it is determined that the voltage margin N-bit word is at least one of greater than the predetermined maximum voltage margin N-bit word and less than the predetermined minimum voltage margin N-bit word, then perform step 314. At step 314, a check is performed to determine if a count of a counter is less than a second predetermined number. The second predetermined number stored in the counter corresponds to the maximum number of times the digital controller 106 calibrates the LVW reference voltage signal. If at step 314 it is determined that the count is less than the second predetermined number, step 316 is performed. At step 316, the digital controller 106 generates the voltage trimming signal based on a comparison of the voltage margin N-bit word with at least one of the predetermined maximum and minimum voltage margin N-bit words. At step 318, the digital controller 106 calibrates the LVW reference voltage signal based on the voltage trimming signal. At step 320, the counter increments the count by binary one. After step 320, step 306 is repeated. If at step 314 it is determined that the count is not less than the second predetermined number, step 322 is performed. At step 322, the digital controller 106 generates the calibration fail signal.

While various embodiments of the present invention have been illustrated and described, it will be clear that the present invention is not limited to these embodiments only. Numerous modifications, changes, variations, substitutions, and equivalents will be apparent to those skilled in the art, without departing from the spirit and scope of the present invention, as described in the claims.

The invention claimed is:

1. A system for calibrating a reference voltage signal in an integrated circuit, comprising:

a digital-to-analog converter (DAC) that receives first and second sets of digital control words and generates corresponding first and second sets of control voltage signals during first and second calibration cycles, respectively;

a voltage monitoring circuit, comprising:

a reference voltage generator that generates first and second reference voltage signals;

a first comparator having a first input terminal connected to the DAC for receiving the first set of control voltage signals, a second input terminal connected to the reference voltage generator for receiving the first reference voltage signal, and an output terminal for outputting a first monitor voltage signal during the first calibration cycle;

a second comparator having a first input terminal connected to the DAC for receiving the second set of control voltage signals, a second input terminal connected to the reference voltage generator for receiving the second reference voltage signal, and an output terminal for outputting a second monitor voltage signal during the second calibration cycle;

a first multiplexer having a first input terminal connected to the DAC for receiving the first set of control voltage signals, a second input terminal for receiving a functional voltage signal of the integrated circuit when the integrated circuit is in a functional mode, a select terminal for receiving a select signal, and an output terminal that provides the first set of control voltage signals in the first calibration cycle; and a second multiplexer having a first input terminal, connected to the DAC for receiving the second set of control voltage signals, a second input terminal for receiving the functional voltage signal of the integrated circuit when the integrated circuit is in the functional mode, a select terminal for receiving the select signal, and an output terminal for outputting the second set of control voltage signals in the second calibration cycle; and a digital controller, connected to the voltage monitoring circuit and the DAC, that receives the first and second monitor voltage signals and generates the first and second sets of digital control words in the first and second calibration cycles, respectively, such that a first reference voltage digital control word of the first set of digital control words corresponds to the first reference voltage signal at the end of the first calibration cycle and a second reference voltage digital control word corresponds to the second reference voltage signal at the end of the second calibration cycle, generates a voltage margin word that corresponds to a difference between the first and second reference voltage digital control words at the end of the first and second calibration cycles, generates a voltage trimming signal based on a comparison between the voltage margin word and at least one of predetermined maximum and minimum reference voltage words and calibrates the second reference voltage signal based on the voltage trimming signal.

2. The system of claim 1, wherein:

the first monitor voltage signal is output at a first logic state when a voltage level of a first control voltage signal of the first set of control voltage signals is less than a voltage level of the first reference voltage signal, the first monitor voltage signal is output at a second logic state when the voltage level of the first control voltage signal is greater than the voltage level of the first reference voltage signal, the second monitor voltage signal is output at the first logic state when a voltage level of a first control voltage signal of the second set of control voltage signals is less than a voltage level of the second reference voltage signal, and the second monitor voltage signal is output at the second logic state when the voltage level of the first control voltage signal of the second set of control voltage signals is greater than the voltage level of the second reference voltage signal.

3. The system of claim 2, wherein the first comparator receives a second control voltage signal of the first set of control voltage signals when the first monitor voltage signal is output at the first logic state, and wherein a voltage level of the second control voltage signal of the first set of control voltage signals is greater than the voltage level of the first reference voltage signal during the first calibration cycle.

4. The system of claim 1, wherein the digital controller further includes means for calibrating the second reference voltage signal until the voltage margin word is less than the predetermined maximum reference voltage word and greater than the predetermined minimum reference voltage word.

5. The system of claim 1, wherein the digital controller further generates a calibration pass signal when the voltage margin word is less than the predetermined maximum reference voltage word and greater than the predetermined minimum reference voltage word.

6. The system of claim 1, wherein the digital controller further generates a calibration fail signal when the voltage margin word is at least one of greater than the predetermined maximum reference voltage word and less than the predetermined minimum reference voltage word.

7. The system of claim 1, further comprising a low voltage detection circuit that includes the first multiplexer and the first comparator.

8. The system of claim 1, further comprising a low voltage warning circuit that includes the second multiplexer and the second comparator.

9. The system of claim 1, wherein the digital controller includes a register that stores the predetermined maximum and minimum reference voltage words.

10. The system of claim 1, wherein the digital controller further includes means for increasing a voltage level of the second reference voltage signal when the voltage margin word is less than the predetermined minimum reference voltage word and decreasing a voltage level of the second reference voltage signal when the voltage margin word exceeds the predetermined maximum reference voltage word.

11. The system of claim 1, wherein the second comparator receives a second control voltage signal of the second set of control voltage signals when the second monitor voltage signal is output at a first logic state, and wherein a voltage level of the second control voltage signal of the second set of control voltage signals is greater than the voltage level of the second reference voltage signal during the second calibration cycle.

12. The system of claim 1, wherein the first and second reference voltage signals correspond to a low voltage detection threshold signal and a low voltage warning threshold signal of the integrated circuit, respectively.

13. A method of calibrating a reference voltage signal of an integrated circuit that includes a digital-to-analog converter (DAC), a voltage monitoring circuit, and a digital controller, comprising:

generating first and second monitor voltage signals based on first and second sets of control voltage signals and first and second reference voltage signals, during first and second calibration cycles, respectively;

generating first and second sets of digital control words corresponding to the first and second sets of control voltage signals during the first and second calibration cycles, respectively, such that a first reference voltage word of the first set of words corresponds to the first reference voltage signal at the end of the first calibration cycle and a second reference voltage digital control word corresponds to the second reference voltage signal at the end of the second calibration cycle;

generating a voltage margin word that corresponds to a difference between the first and second reference voltage digital control words at the end of the first and second calibration cycles;

generating a voltage trimming signal based on a comparison between the voltage margin word with at least one of predetermined maximum and minimum reference voltage words; and calibrating the second reference voltage signal based on the voltage trimming signal, wherein the first and second reference voltage signals corresponds to a low voltage detect threshold signal and a low voltage warning threshold signal of the integrated circuit, respectively.

14. The method of claim 13, wherein the step of calibrating the second reference voltage signal is performed until the voltage margin word is less than the predetermined maximum reference voltage word and greater than the predetermined minimum reference voltage word.

15. The method of claim 13, further comprising generating a calibration pass signal when the voltage margin word is less than the predetermined maximum reference voltage word and greater than the predetermined minimum reference voltage word.

16. The method of claim 13, further comprising generating a calibration fail signal when the voltage margin word is at least one of greater than the predetermined maximum reference voltage word and less than the predetermined minimum reference voltage word.

17. The method of claim 13, wherein the step of calibrating the second reference voltage signal comprises increasing a voltage level of the second reference voltage signal when the voltage margin word is less than the predetermined minimum reference voltage word.

18. The method of claim 13, wherein the step of calibrating the second reference voltage signal comprises decreasing the voltage level of the second reference voltage signal when the voltage margin word exceeds the predetermined maximum reference voltage word.

* * * * *